US009868094B2

(12) United States Patent
Gitis et al.

(10) Patent No.: US 9,868,094 B2
(45) Date of Patent: Jan. 16, 2018

(54) BUBBLE GENERATOR

(71) Applicant: Sami Shamoon College of Engineering (R.A.), Beer Sheva (IL)

(72) Inventors: Vitaly Gitis, Arad (IL); Inna Levitsky, Beer Sheva (IL); Dorith Tavor, Omer (IL)

(73) Assignee: Sami Shamoon College of Engineering (R.A.), Beer Sheva (IL)

( * ) Notice: Subject to any disclaimer, the term of this patent is extended or adjusted under 35 U.S.C. 154(b) by 0 days.

(21) Appl. No.: 15/522,421

(22) PCT Filed: Sep. 10, 2015

(86) PCT No.: PCT/IL2015/050930
§ 371 (c)(1),
(2) Date: Apr. 27, 2017

(87) PCT Pub. No.: WO2016/067278
PCT Pub. Date: May 6, 2016

(65) Prior Publication Data

US 2017/0326511 A1 Nov. 16, 2017

Related U.S. Application Data

(60) Provisional application No. 62/068,786, filed on Oct. 27, 2014.

(51) Int. Cl.
*B01F 3/04* (2006.01)
*B01F 5/00* (2006.01)

(52) U.S. Cl.
CPC ..... *B01F 5/0057* (2013.01); *B01F 3/04503* (2013.01); *B01F 2003/04872* (2013.01)

(58) Field of Classification Search
CPC ..... B01F 3/04503; B01F 5/0057; B01F 2003/04872
(Continued)

(56) References Cited

U.S. PATENT DOCUMENTS 2,653,801 A 9/1953 Fontein
3,794,299 A * 2/1974 Wagner ..... B01F 5/0057 210/198.1
(Continued)

FOREIGN PATENT DOCUMENTS

EP 0029814 B1 6/1981
FR 1071111 A 8/1954

OTHER PUBLICATIONS

Cui Z.F., Chang S., Fane A. G., "The use of gas bubbling to enhance membrane process". J. of Memb. Sci., 221, 2003.
(Continued)

*Primary Examiner* — Charles Bushey
(74) *Attorney, Agent, or Firm* — Moss & Barnett; Michael A. Bondi

(57) ABSTRACT

The present invention is a novel bubble generator that can be used in many different industrial applications. The design of the bubble generator of the invention allows its user to selectively generate gas bubbles in a liquid having a wide range of diameters in the range from microns to millimeters simply by changing the ratio of the flow rate of the gas to that of the liquid. The bubbles are generated at low liquid and gas supply pressure values. The bubble generator of the invention is able to create an unstable liquid flow regime having large amplitudes and frequencies for liquid containing bubbles without the use of moving mechanical parts and drives.

16 Claims, 5 Drawing Sheets

(58) Field of Classification Search
USPC ..... 261/79.2
See application file for complete search history.

(56) References Cited

U.S. PATENT DOCUMENTS

| | | | | |
|---|---|---|---|---|
| 4,053,142 | A * | 10/1977 | Johannes | B01F 5/0068 366/165.1 |
| 4,267,131 | A | 5/1981 | Prudhon | |
| 4,269,797 | A | 5/1981 | Mikiya | |
| 4,382,045 | A * | 5/1983 | Wem | B01D 3/30 261/79.2 |
| 4,512,514 | A | 4/1985 | Elcott | |
| 4,618,350 | A | 10/1986 | Rowe | |
| 5,110,512 | A | 5/1992 | Kwon | |
| 6,382,601 | B1 | 5/2002 | Ohnari | |
| 6,613,231 | B1 | 9/2003 | Jitariouk | |
| 6,962,169 | B2 | 11/2005 | Kaske | |
| 7,059,591 | B2 * | 6/2006 | Bortkevitch | B01F 3/0446 261/76 |
| 7,832,028 | B2 | 11/2010 | Yayama | |
| 7,887,702 | B2 | 2/2011 | Park | |
| 2006/0102234 | A1 | 5/2006 | Meisel | |
| 2015/0000524 | A1 * | 1/2015 | Davydov | B01D 53/18 95/151 |

OTHER PUBLICATIONS

Li Q.Y., Cut Z.F., Pepper D.S., "Effect of bubble size and frequency on permeate flux in gas sparged ultrafiltration with tubular membranes". Chem. Eng. J. 67, 1997.

Ghosh R., etc., "Enhancement of ultrafiltration by gas sparging with flat sheet membrane modules". J. Separation and Purification Technology 14, 1998.

Ding L. H., Jaffrin M.Y., and Defossez M., "Concentration polarization formation in ultrafiltration of blood and plasma", J. Memb. Sci, 84, 293, 1993.

Gupta B.B., Blanpain P., Jaffrin M.Y., "Permeate flux enhancement by pressure and flow pulsations in microfiltration with mineral membranes". J. Memb. Sci., 70, 256, 1992.

International Search Report and Written opinion for PCT App. No. PCT/IL2015/050930 dated Dec. 28, 2015, 6 pgs.

* cited by examiner

BUBBLE GENERATOR

REFERENCE TO RELATED APPLICATIONS

This application claims priority to Provisional Applic. No. 62/068,786, filed on Oct. 27, 2014, and PCT Application No. PCT/IL2015/050930 filed Sep. 10, 2015, the contents of which are incorporated herein by reference.

FIELD OF THE INVENTION

The invention is from the field of bubble generation. Specifically the invention relates to bubble generators for dissolving gases in liquids.

BACKGROUND OF THE INVENTION

In recent years, gas-liquid mixture fluids containing micro bubbles have been used in various industries, for example: to dissolve a dioxin water mass in a closed water area, as an activation means of microorganisms in drainage treatment, for facilitation of the growth of plants in hydroponics and the like, for removal of contaminating substances on the surfaces of a material, and as a technique capable of supplying various gases into water by making such gases in the form of micro bubbles.

Air oxidation in a liquid phase is one of the reactions most commonly employed in various industrial processes. In carrying out this reaction, air is generally blown under pressure into water through fine pores of a tubular or planar micro-bubble generating system installed at the bottom or in the lower portion of the side wall of a tank.

A known design of bubble generator comprises a bubble plate which is provided with an air chamber to be connected to a source of compressed gas. The air chamber has a bubble generating face comprising a number of openings. When the bubble generator is immersed in liquid air in the chamber, which escapes through the holes forms bubbles in the liquid. A mechanical arrangement is provided to change the size of the openings in the bubble generating face and therefore the diameter of the bubbles produced. Bubble generators having this design are described in EP0029814B1, and U.S. Pat. No. 4,269,797; U.S. Pat. No. 5,110,512.

It must be noted that in aeration systems using this conventional type of bubble generating system, even when fine pores are provided in the bubble plate, the volume of each of the air bubbles expands and the diameter of each bubble increases to several millimeters due to surface tension of the air bubbles during injection. When bubbles are supplied into water, it is known that for the same volume of gas, minimizing the outer diameter of the bubbles increases the surface area of the bubbles relative to their, thereby enlarging the contact area between the gas in the bubbles and the water.

The disadvantages of this type of bubble generator are difficulty of forming bubbles with small diameter, clogging of the small pores, and the high energy consumption required to generate the bubbles. This type of bubble forming means also fails to provide enough rapid and efficient oxidation.

The introduction of gas/liquid two-phase flow has been shown to significantly enhance the performance of some membrane process applications (Cui Z. F., Chang S., Fane A. G., "The use of gas bubbling to enhance membrane process". J. of Memb. Sci., 221, 2003). The basic mechanism of the enhancement by gas sparging was attributed to the secondary flow induced by air bubbles (Li Q. Y., Cut Z. F., Pepper D. S., "Effect of bubble size and frequency on permeate flux in gas sparged ultrafiltration with tubular membranes". Chem. Eng. J. 67, 1997). The secondary flow around the air bubbles then promotes local mixing, reduces the thickness of the mass transfer boundary layer and increases the mass transfer coefficient. Consequently, the mass transfer rate of solute molecules from the membrane surface back to the bulk solution is increased. Injecting air bubbles can increase the permeate fluxes by 7% to 50% and higher (Ghosh R., etc., "Enhancement of ultrafiltration by gas sparging with flat sheet membrane modules". J. Separation and Purification Technology 14, 1998). The complicated designs of these existing systems and increased consumption of energy by them are disadvantages of this technology.

U.S. Pat. No. 6,382,601 describe a bubble generator design, which overcomes these disadvantages. The bubble generator comprises a tangential channel through which water is supplied to a conical space through a cylindrical inner wall with sufficient volume and pressure to develop a vortex in the flowing liquid and gas is introduced into the flowing liquid orthogonally through a porous wall. U.S. Pat. No. 4,618,350 propose creation of two phase flow by injection in the vessel gas at high tangential velocity. The large centrifugal force field ensures that the relatively dense liquid droplets spiral outwards, counter-current to the inwardly-spiraling gas.

The most vital portion of the generator related to the bubble generation in the swirling jet method is the flow region in the vicinity of the jet exit. A swirling type micro-bubble generating system described in U.S. Pat. No. 7,832,028 is constructed by arranging two fine-bubble generating sections in a rectangular parallelepiped casing with spouts of fine bubble generating sections facing each other. The bubble generating sections have chambers containing rotating liquid with gas introducing passages opened into each of the chambers through partition walls separating them. According to the inventors of this system, it is possible to readily generate micro-bubbles in industrial scale, and the system is relatively small in size and has simple structure and can be easily manufactured.

Disadvantages of the bubble generator of U.S. Pat. No. 7,832,028 are the air is introduced into vortex chamber on the vortex chamber axis, which doesn't permit using water having high tangential velocity for creating bubbles. Also, the long vortex chamber reduces the rotational velocity in the liquid as a result of angular momentum losses. This reduces the efficiency of the bubble generator design and increases the energy consumption. In this design is difficult to optimize the geometrical parameters and a great deal of experimental work must be done to obtain the requested results.

One of the most effective approaches for providing good liquid filtering along with creating two phase flow is to induce liquid instability near the membrane surface by using an intermittent jet or pulsating flow. Among the mechanisms proposed to explain the enhanced performance is one that suggests that pulsation produced enhanced shear when flow reversal of the bulk solution was achieved (Ding L. H., Jaffrin M. Y., and Defossez M., "Concentration polarization formation in ultrafiltration of blood and plasma", J. Memb. Sci, 84, 293, 1993). It is postulated by Ding et al. that, after a stable pressure period during which a cake was formed, a low-pressure peak caused destabilization of the cake layer. Then during the high-pressure peak, high shear removed many particles from the cake layer. It has been demonstrated experimentally that with a waveform in which the high pressure peak followed the stable pressure period, the high maximum shear removed fewer particles from the cake layer than when the boundary layer was destabilized first (Gupta B. B., Blanpain P., Jaffrin M. Y., "Permeate flux enhancement by pressure and flow pulsations in microfiltration with mineral membranes". J. Memb. Sci., 70, 256, 1992). When an intermittent jet is used, the generation and characteristics of the vortices essentially arise from the inertial effects due to the difference in velocity between the jet and the surrounding liquid. The shear stresses coming from viscosity effects or turbulence will affect the development of these vortices and the rapidity of transfer of the energy they contain result in smaller and smaller eddies.

One of the methods for creating pulsating flow for improving membrane separation process and an apparatus for its realization is proposed in U.S. Pat. No. 6,613,231. The method comprises using four flat fixed membranes, at least three bodies rotating next to the selective layer of the membranes that generate secondary vortices, and providing at least one device that generates oscillations in the liquid. Flow rate in the intermediate cell will increase or decrease cyclically as the impeller of the device set on a solid or hollow shaft rotates around its axis, and allows obtain oscillating liquid flow in each intermediate cell of the apparatus for membrane separation. The aforementioned oscillatory conditions in liquid facilitate removal of liquid from membrane selective layers, thus enabling to ensure high specific permeability for a long period of time. This means that it is possible to reduce the frequency of washing and replacement of membranes.

U.S. Pat. No. 6,962,169 and U.S. Pat. No. 7,887,702 describe apparatuses, in which pulsate flow is created by a rotation element through which flow is supplied to membrane. The device comprises a liquid inlet, a liquid outlet and a blocking element that is located between the liquid inlet and the liquid outlet and that rotates about an axis. The blocking element comprises a blocking member which cyclically closes and opens a liquid passage from the inlet to the outlet. In the device the pulsating frequency of the resultant pulsating liquid stream corresponds to twice the rotational frequency of the blocking element. Apparatuses which use this method are mechanically complicated and experience problems of wear, bulkiness' and adjustment—particularly concerning the rotating parts.

U.S. Pat. No. 4,512,514 describe a method for creating a pulsating liquid flow conditions by using an elastic element overlapping the supply channels. One of the embodiments of a device that implements this method consists of an elastic tube and a casing. The casing surrounds the elastic tube and forms a space between the inner surface of the rigid casing and the outer surface of the elastic tube. Liquid flows into the pulsator through its inlet at a low controlled continuous flow rate and is ejected through its outlet at a high intermittent pulsating flow. In this arrangement the volume of air surrounding the elastic tube and enclosed in the casing is compressed during the expansion of the elastic tube. A significant drawback of the proposal is the need to supply to a liquid or gas at a pressure that is greater than the pressure in the flow which must be to filtering. In addition, the introduction of the device of elastic deformable element does not allow the creation of flow pulsation with high frequency. This device is also limited in the length of time it can operate.

According to its design, the easiest way to create a pulsating flow is proposed in US 2006/0102234. This patent application describes a flow control device that creates a pulsating flow. The device includes a body with a flow passage defined there through, a flow interruption element and means, for example, a spring that moves the flow interruption element between a flow interrupting position and an open position. Under the influence of differential pressure acting on the element, the spring is compressed opening passage for liquid. After a rise in pressure in the output cavity the force of the spring on the element will push the element to block passage of the liquid. Despite this simple construction this method for creating pulsed liquid flow regime has several disadvantages, which primarily relate to time constraints on the action of the device, limitation of the flow rate, and lack of ability to control the frequency of pulses.

Analysis of existing methods and designs to create air bubbles and liquid flow pulsating regimes shows the need for a new design that would be simple to implement, does not require the use of electric drives for rotating parts of the device or a source with higher liquid pressure. The design of a new device must be capable of producing bubbles with diameters in a wide range of sizes from micrometers to millimeter and must not include elastic deformable elements that would impose restrictions on the time action, liquid flow values, and ability to control the frequency and amplitude of the pulsations. In addition the new device must require low energy consumption.

It is a purpose of the present invention to provide a generator for the creation of air bubbles and liquid flow pulsating regimes that is capable of producing bubbles with diameters in a wide range of sizes, does not include elastic deformable elements, and has low energy consumption.

Further purposes and advantages of this invention will appear as the description proceeds.

SUMMARY OF THE INVENTION

The invention is a bubble generator that has no moving parts and is configured to generate gas bubbles having a wide range of diameters in a liquid simply by changing the ratio of the flow rate of the gas to that of the liquid. The bubble chamber comprises:

a. a vortex chamber having a cylindrically shaped wall that defines a vortex chamber cavity;
b. openings in the cylindrically shaped wall through which the liquid is introduced tangentially into the vortex chamber cavity;
c. a cylindrical bushing with a blind gas channel that is coaxial with the vortex chamber; and
d. orifices at the lower end of the gas channel in the bushing through which low-velocity gas jets are radially injected into the liquid flow near the center of the vortex chamber cavity.

Embodiments of the bobble generator of the invention comprise:

a. a body having a hollow side arm near its top through which liquid is introduced into the bubble chamber;
b. a cavity hollowed out of the interior of the upper part of the body into which the bushing and vortex chamber is inserted;
c. a cavity hollowed out of the interior of the lower part of the body. the cavity having the shape of an inverted cone that acts as an exhaust diffuser;
d. a space between the wall of the vortex chamber and the interior wall of the body, which is in fluid communication with the side arm and forms a liquid reservoir from which liquid flows tangentially through the openings in the vortex chamber wall into the vortex chamber cavity; and e. an opening at the bottom of the vortex chamber cavity that forms an outlet nozzle through which the two-phase medium leaves the vortex chamber and passes into the exhaust diffuser.

Embodiments of the bubble generator of the invention comprise n openings in the cylindrically shaped wall that are equally spaced around the circumference of the vortex chamber, wherein the n openings each have diameter $d_t$, length $L_t$, and their centers are offset from the center of the vortex chamber by distance R. In embodiments of the bubble chamber of the invention the n openings are arranged in at least two layers separated by vertical distance L.

In embodiments of the bubble generator of the invention the orifices at the bottom of the blind gas channel are equally spaced around the circumference of the bushing and have diameters $d_a$. In embodiments of the bubble chamber of the invention the orifices are arranged in at least two layers that are separated by vertical distance L between centers and vertical distance Δ between the edges of orifices in two adjacent layers.

In embodiments of the bubble generator of the invention the opening at the bottom of the vortex chamber cavity is comprised of a conical section having a cone angle α, which is coupled to the outlet nozzle having radius $r_n$ by means of a curved wall portion having radius of curvature r, and the outlet nozzle is connected to the exhaust diffuser by a tapered section of wall having maximum radius $r_d$. In embodiments of the bubble chamber of the invention α is in the range 45 degrees to 120 degrees. In embodiments of the bubble chamber of the invention the ratio $r:r_n$ is in the range 0.8-1.0.

In embodiments of the bubble generator of the invention the ratio of the tangential flow velocity to the axial flow velocity of the two phase gas-liquid medium as it flows through the outlet nozzle of the vortex chamber is determined by a parameter $$A = \frac{R \cdot r_n}{n \cdot r_t^2}.$$

In embodiments of the bubble chamber of the invention the value of A is in the range of 4 to 6.

In embodiments of the bubble generator of the invention the radius of the tip lateral surface the bushing 22 at the location of the orifices 24 is given by the equation:

$$r_b \geq r_n \cdot \sqrt{1-\varphi}$$

where: $r_b$=the radius of the tip of the bushing;

$r_n$=the radius of the vortex chamber nozzle;

φ=a parameter, defined by the characteristic of A of the vortex chamber, according to the following equation:

$$A = \frac{\sqrt{2}\,(1-\varphi)}{\varphi\sqrt{\varphi}}.$$

In embodiments of the bubble generator of the invention is which the ratio of the volume flow rates of water $Q_w$ to air $Q_{air}$ are in the range $22 \leq Q_w/Q_{air} \leq 28$ air bubbles with diameter 10-20 μm are obtained.

Embodiments of the bubble generator of the invention comprise at least one pin inserted into the exhaust diffuser to generate oscillations having a given frequency and amplitude in the two phase gas-liquid medium flowing out of the bubble chamber. In embodiments of the bubble chamber of the invention the at least one pin protrudes into the exhaust diffuser a distance $0.3r_{inst} \leq L_p \leq 0.5r_{inst}$, where $r_{inst}$ is the radius of the cavity at the location of the at least one pin. In embodiments of the bubble chamber of the invention the diameter $d_p$ of the at least one pin is related to the radius $r_{inst}$ by the equation $0.3r_{inst} \leq d_p \leq 0.5r_{inst}$.

All the above and other characteristics and advantages of the invention will be further understood through the following illustrative and non-limitative description of embodiments thereof, with reference to the appended drawings.

DETAILED DESCRIPTION OF EMBODIMENTS OF THE INVENTION

The present invention is a novel bubble generator that can be used in many different industrial applications. The design of the bubble generator of the invention allows its user to selectively generate gas bubbles in a liquid having a wide range of diameters simply by changing the ratio of the flow rate of the gas to that of the liquid. The bubbles are generated at low liquid and gas supply pressure values. Amongst the advantages of this generator is the fact that, at the location of the liquid and gas interaction, the liquid has maximal value of the tangential velocity and has pressure equal to the exit pressure of the medium from the bubble generator. This allows creation of bubbles with minimum diameter of less than 20 μm to bubbles having diameters of several mm at low gas supply pressure. Another advantage of the bubble generator of the invention is the ability to create an unstable liquid flow regime having large amplitudes and frequencies for liquid containing bubbles without the use of moving mechanical parts and drives.

The key technical problems that are solved by the design of the bubble generator of the invention are: producing air bubbles in a wide range of sizes according to the user's choice, including the bubbles with outer diameters on the order of tens of microns and producing unsteady flow with oscillation having user selected amplitudes and frequency; while, at the same time, raising the velocity of the liquid relative to the gas and decreasing the gas and liquid supply pressures in the region of their interaction.

Figure 1:
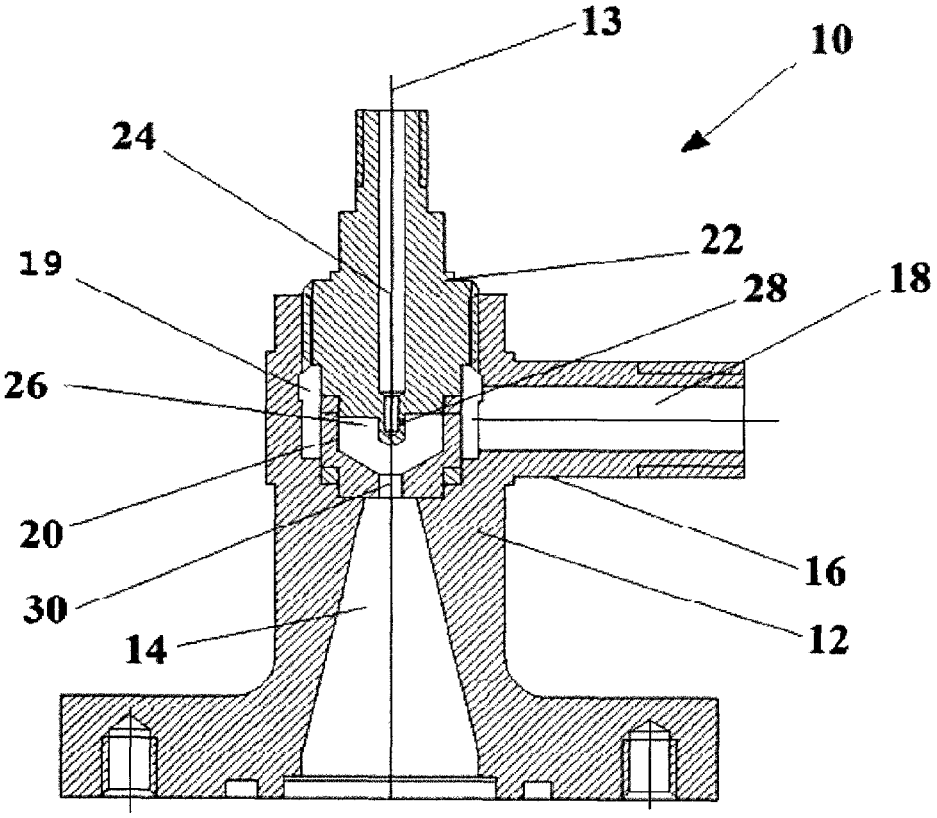
FIG. 1 is a vertical cross-sectional view that schematically shows the bubble generator of the invention.

FIG. 1 is a vertical cross-sectional view that schematically shows the bubble generator 10 of the invention. Bubble generator 10 is comprised of a body 12, which in cross-section essentially has the shape of an upside down "T" and in three dimensions is cylindrically symmetric around symmetry axis 13—with the exception of side arm 16 located near its top. The interior of the upper part of body 12 is hollowed out to form a cavity into which a vortex chamber 20 is inserted. Vortex chamber 20 is held in place inside body 12 by means of bushing 22. The interior of vortex chamber 20 is vortex chamber cavity 26. The interior of the lower part of body 12 is hollowed out to form a cavity having the shape of an inverted cone that acts as an exhaust diffuser 14.

Side arm 16 is hollow forming a liquid channel 18 through which liquid is introduced the space between the exterior wall of vortex chamber cavity 26 and the interior wall of body 12, as will be described with respect to FIG. 2 this space forms a liquid reservoir from which the liquid enters vortex chamber cavity 26.

The interior of bushing 22 is hollow until its lower end; the hollow interior forming a blind gas channel 24 having a circular cross-section. In the side of gas channel 24 at its lowest end there are a number of small orifices 28 that allow gas flowing through gas channel 24 to enter radially into vortex chamber cavity 26. An opening at the bottom of vortex chamber cavity 26 forms an outlet nozzle 30, through which the two-phase medium leaves the vortex chamber and passes into the exhaust diffuser 14.

Figure 2:
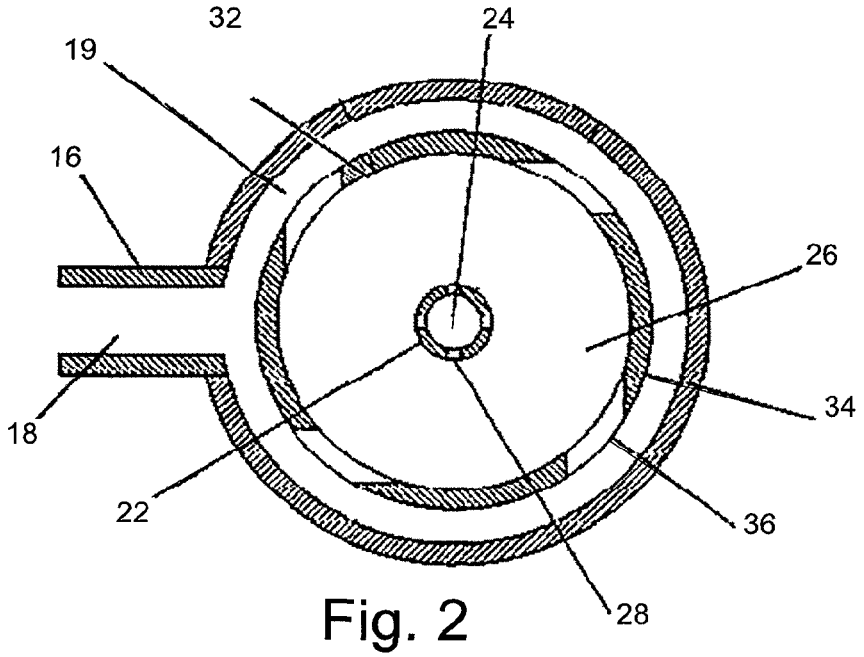
FIG. 2 is a schematic horizontal cross-sectional view of the bubble generator of the invention in a plane passing through the orifices in the gas channel inside the vortex chamber cavity.

FIG. 2 is a schematic horizontal cross-sectional view of the bubble generator 10 in a plane passing through the orifices 28 in the gas channel 24 inside vortex chamber cavity 26. Liquid that flows into the bubble generator through liquid channel 18 in side arm 16 flows into liquid reservoir 19 of the bubble generator body 12 surrounding the wall 34 of vortex chamber 20. In the wall 34 are created a number of equally spaced openings 36 that are shaped such that liquid flowing openings 36 will flow from reservoir 19 into vortex chamber cavity 26 in a direction tangential to the inner side 32 of wall 34. Note that in the embodiment of vortex chamber 20 shown in the figures there are four openings 36; however there can be more or less of these openings—in this embodiment there are actually eight openings 36 arranged in two layers (see FIG. 4)—as long as certain dimensional constraints described herein below are satisfied.

At the center of vortex chamber cavity 26 can be seen the lower end of the wall of bushing 22, the gas channel 24, and some of the equally spaced orifices 28 through which gas flows in a radial direction into vortex chamber cavity 26. Note that in the embodiment of vortex chamber 20 shown in the figure there are four orifices 28 visible; however there can be more or less of these orifices—in this embodiment there are actually eight orifices 28 arranged in two layers (see FIG. 5)—as long as certain dimensional constraints described herein below are satisfied.

The bubble generator of the invention is designed such that the tangential flow velocity of the fluid increases and the pressure of the fluid decreases as the distance from wall 32 increases. As a result the necessary pressure head for injecting the gas into the vortex chamber is minimal, while turbulence is maximal. These conditions enable generation of gas bubbles at low pressure values and with low air flow rates.

Since the diameters of the gas bubbles decrease with increasing relative velocity between liquid and gas, the radial injection of low-velocity gas jets into the liquid flow near the center of the vortex chamber cavity provide for the production of small diameter gas bubbles at chosen operating parameters. Note that the design of the bubble generator 10 enables low values of the operating parameters, i.e. the gas and liquid supply pressures, to be reached.

Figure 3:
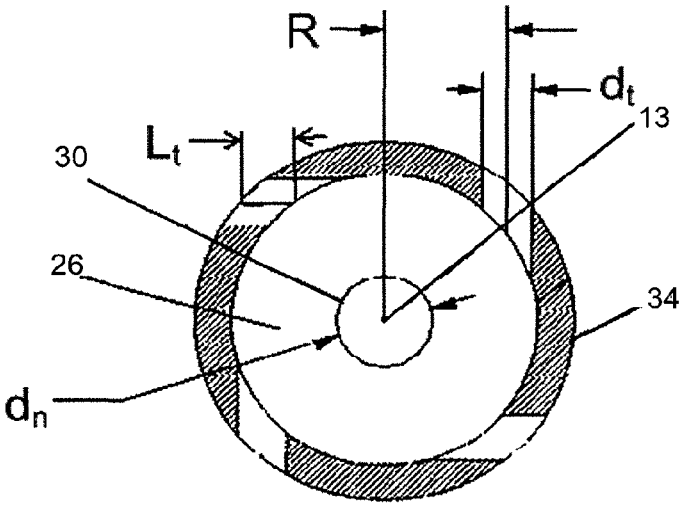
FIG. 3 is a schematic horizontal cross-sectional view of the vortex chamber.
Figure 4:
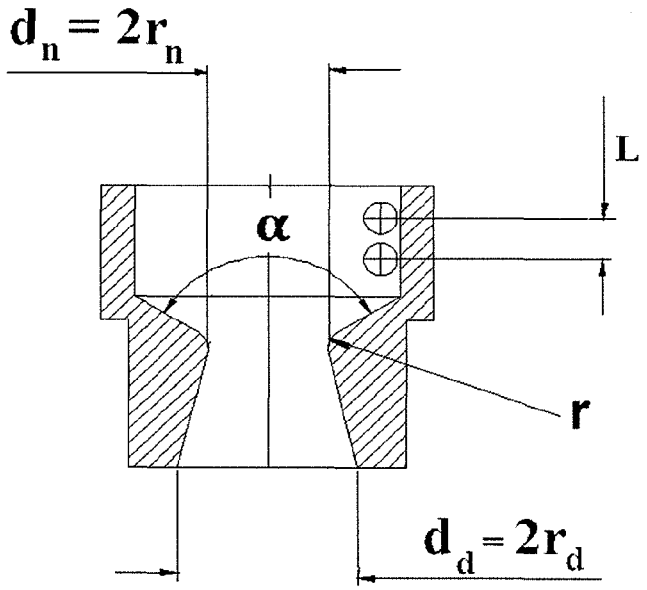
FIG. 4 is a schematic horizontal cross-sectional view of the vortex chamber showing the design of the vortex chamber exit nozzle.

FIG. 3 schematically shows a horizontal cross-sectional view of the vortex chamber 20. FIG. 4 schematically shows a vertical cross-sectional view of the vortex chamber cavity 24, showing the design of the vortex chamber exit nozzle 30.

In the inner wall 32 of vortex chamber tangential openings 36 allow fluid to flow into the interior of vortex chamber cavity 26. Openings 36 have diameter $d_t$ and are displaced from the symmetry axis 13 by distance R. The two phase mixture of liquid and dissolved gas bubbles exits the vortex chamber cavity 26 through outlet nozzle 30, which has diameter $d_n=2r_n$. In order to reduce hydraulic losses the end wall of the vortex chamber cavity on the outlet nozzle side has a conical shape tapering down to radius $r_n$ before again gradually increasing to radius $r_d=d_d/2$. The cone angle $\alpha$ of the vortex chamber end wall is in the range 45°-120°. In order to reduce pressure losses the conical vortex chamber wall is coupled to outlet nozzle 30 by a curved portion having radius of curvature. The ratio $r/r_n$ is in the range $r/r_n=0.8\text{-}1$.

The possibility of obtaining the desired ratio between the tangential and the axial flow velocities in the exit nozzle is determined by the value of a parameter A, which is a parameter that represents the geometrical characteristic of a vortex chamber [Dityakin Y. F., Klyachko L. A., Novikov B. V., Yagodkin V. I., *Liquid Spraying*, Moscow, Mashinostroenie, pp. 25-32, 1977].

A is determined by the equation:

$$A = \frac{R \cdot r_n}{n \cdot r_t^2}$$

where,

A—geometrical characteristic of a vortex chamber;

R—the distance of the tangential cannel axis from axis of the vortex chamber;

$r_n$—the radius of the vortex chamber nozzle;

$r_t=d_t/2$—the radius of the tangential liquid channels;

n—the number of tangential liquid channels.

Since small air bubbles can be obtained at a large ratio between the tangential and axial water velocities at the vortex chamber outlet nozzle the value of A is taken to be between 4 and 6.

Since the liquid in the vortex chamber moves according to the equation VR=constant, where V is the liquid velocity in the tangential openings 36, the tangential velocity of the liquid increases with decreasing radius, and has a maximum value at a radius equal to the radius of the gas cavity $r_\varphi$. At radius $r_\varphi$ the pressure is equal to the value of exit pressure of the two phase solution at the outlet nozzle 30. Therefore, outflow through the outlet nozzle 30 has an annular cross-section with the thickness of the ring equal to the distance between the radius of the gas cavity and the radius of the vortex chamber outlet nozzle 30, i.e. $r_n\text{-}r_\varphi$.

The radius of the tip lateral surface the bushing 22 at the location of the orifices 24 is given by the equation:

$$r_b \geq r_n \cdot \sqrt{1-\varphi}$$

where:

$r_b$=the radius of the tip of the bushing;

$r_n$=the radius of the vortex chamber nozzle;

φ=a parameter, defined by the characteristic of A of the vortex chamber, according to the following equation:

$$A = \frac{\sqrt{2}(1-\varphi)}{\varphi\sqrt{\varphi}}.$$

The internal measurements of the vortex chamber should be as small as possible since it is necessary to keep the liquid rotating in the chamber and if the volume of the chamber is large then the value of the tangential velocity will be reduced together with the effectiveness of the of gas and liquid interaction.

For a bubble generator designed for large water flow the inventors propose creating the vortex chamber with an arrangement of tangential openings 36 arranged in several rows—see FIG. 4, which shows two rows separated by distance L—while maintaining the value of its characteristic A within the above specified range of values. In this way the number of tangential channels is increased which allows their diameters to be reduced while preserving the overall cross-sectional area of the openings and maintaining the distance R (FIG. 2). Thus the diameter of the vortex chamber cavity can be reduced. The total length of the tangential openings must be sufficiently long in relation to their radius, i.e. the ratio $Lt/r_t$, in order to produce the desired flow in the tangential direction inside the vortex chamber cavity, therefore, increasing the number of openings allows the diameter of the individual openings to be decreased and, for a given value of the ratio $Lt/r_t$ allows their length $L_t$, i.e. the thickness of wall 34 of the vortex chamber, to be reduced. From experimental flow investigations the inventors have found that the optimum ratio of the axial line length of the openings 36 $L_t$ to their radius $r_t$ should obey the relation $L_t/r_t \geq 1.5 \div 2$.

In addition the inventors have found that the distance between the rows of tangential openings L should obey the relation $L \geq d_t$ in order to obtain the minimal height of the vortex chamber. The height of the vortex chamber is connected with the diameter $d_t$ of the tangential openings and the number of rows by the equation:

$$L_{vor} = d_t * n + \Delta * (n-1)$$

where, $L_{vor}$=the vortex chamber height;

n=the number of rows of tangential openings; and

Δ=the vertical distance between openings in each row [see FIG. 4]

Figure 5:
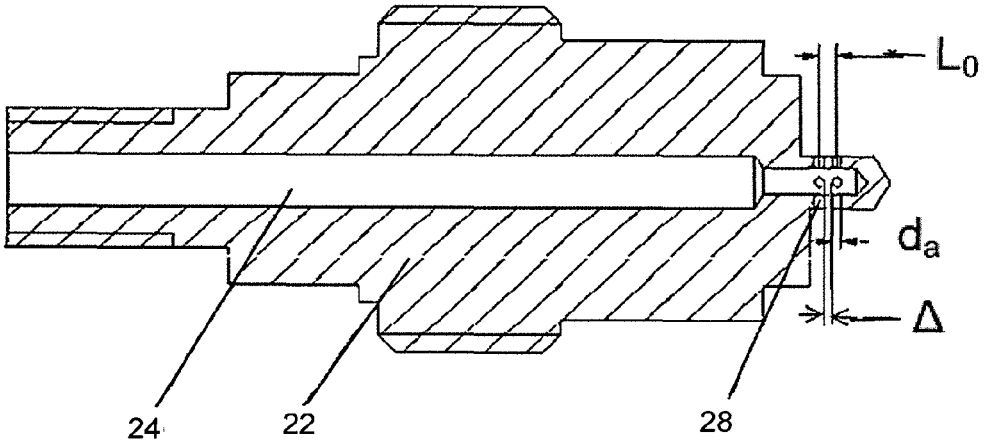
FIG. 5 schematically shows a cross-sectional view of the bushing used to introduce gas into the vortex chamber cavity.

To produce small air bubbles in a liquid flowing with a large flow rate, the orifices for the entrance of the gas into the vortex chamber cavity also are arranged in levels separated by distance $L_0 \geq d_a$, where $d_a$ is the diameter of the air supply orifices 28 located at the center of the vortex chamber cavity 26 (FIG. 5).

Figure 6:
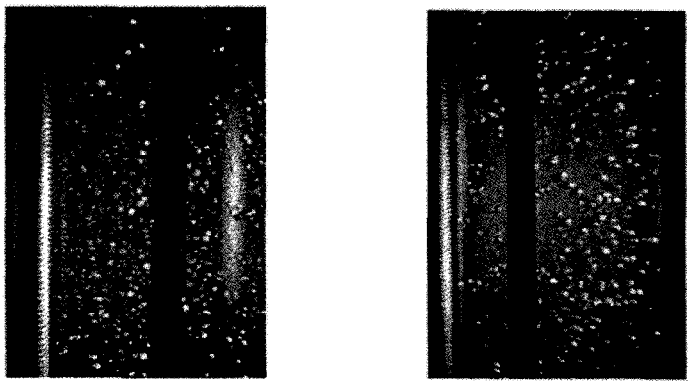
FIG. 6 is two photographs taken at an exit tube connected to a prototype generator of the invention.

Measurements carried out on a prototype of the bubble generator of the invention show that it can create air bubbles in water having diameters in a large range from less than 20 μm to several mm at low water and air supply pressure (FIG. 6). The experiments were carried out using Laser Doppler Velocimetry (LDV) measurement technique for measurements of bubbles with diameters in the micron range and a high speed photo camera (Canon D1100 with lenses 18-55 f 4.5 and speed 1/4000 sec) for measurements of bubbles with mm dimensions. The diameters of the bubbles generated by the bubble generator of the invention are determined by the ratio of the volumetric flow rates of the liquid to gas.

FIG. 6 shows two photographs taken at an exit tube connected to a prototype generator of the invention. In these experiments the liquid was water and the gas air. In the photograph on the left the ratio of the flow rates=$Q_w/Q_{air}$=14 and the measured diameter of the bubbles is $d_b$=0.5 mm. In the photograph on the right the ratio of the flow rates=$Q_w/Q_{air}$=7.2 and the measured diameter of the bubbles is $d_b$=2.0 mm. It should be noted that this refers to the diameters of the majority of bubbles. And along with the given diameter, there are bubbles having diameters larger and smaller than the indicated values. In these experiments the diameters of the bubbles were determined using a program "Measuring tools.exe". This program assumes insignificant optical distortion when processing the images and determines the diameters of the observed air bubble $d_b$ by measuring the diameters of the bubbles in the images and comparing the diameters to those of a standard bubble having diameter $d_0$=1 mm.

Figure 7:
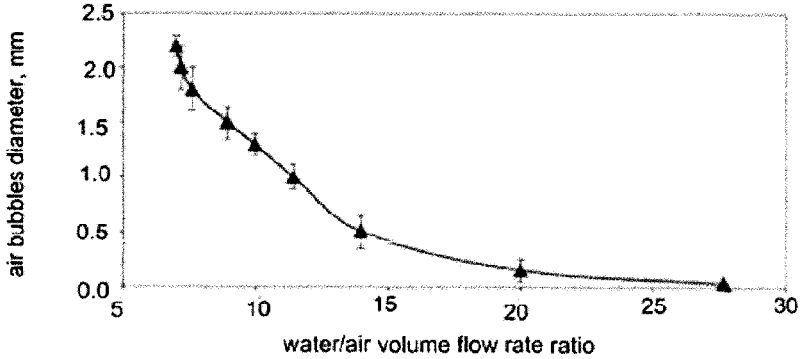
FIG. 7 is a graph showing the dependence of air bubbles diameter on the liquid/air volume ratio.

FIG. 7 is a graph showing the dependence of the diameter of air bubbles on the liquid/air volumetric flow ratio. From a much larger number of measurements than those shown in FIG. 7 it has been found that for creating air bubbles with diameter 10-20 μm the ratio of the volume flow rates of water to air must be in the range $22 \leq Q_w/Q_{air} \leq 28$.

Figure 8:
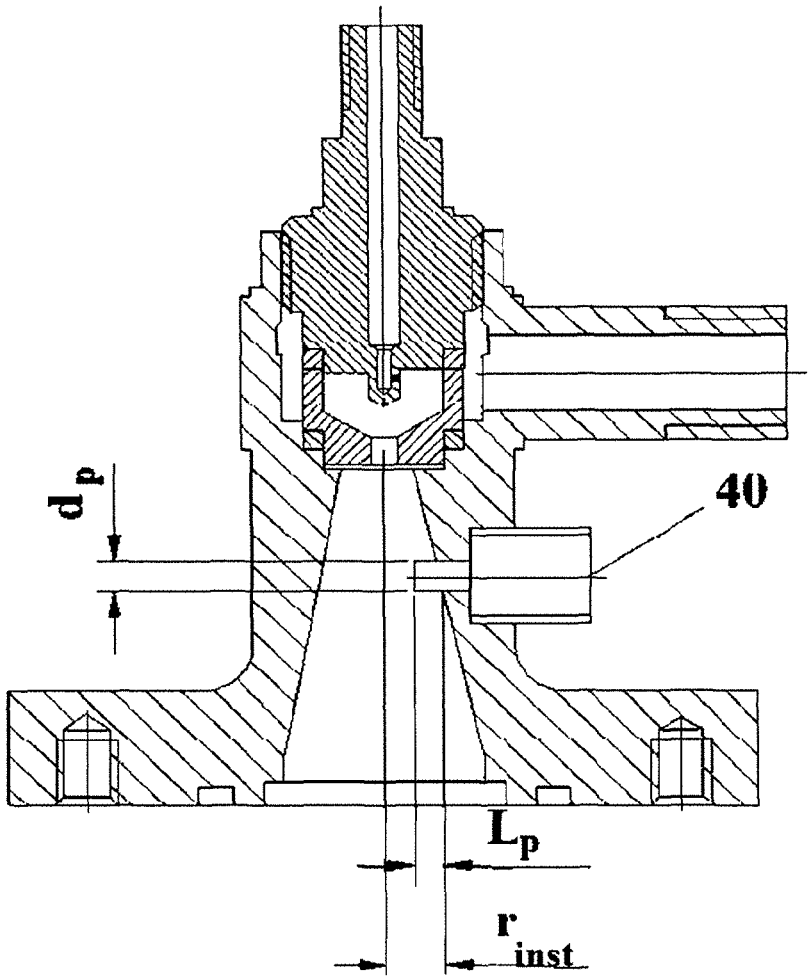
FIG. 8 schematically shows an embodiment of the bubble generator of the invention that is adapted to produce an unstable flow regime with a given frequency of fluctuations.

To create an unstable flow regime with a given frequency of fluctuations in the output of the bubble generator cavity, one or more cylindrical pins 40 are inserted into the exhaust diffuser 14 as shown in FIG. 8. The pin/s protrude into the exhaust diffuser a distance $$0.3 r_{inst} \leq L_p \leq 0.5 r_{inst}$$

where $r_{inst}$ is the radius of the cavity at the location of the pin/s. Since a large pin diameter decreases the cross section of the liquid flow, and therefore creates large hydraulic resistance, it has been found experimentally that the best results are obtained when the diameter $d_p$ of the pins is connected to the radius $r_{inst}$ by the equation $$0.3 r_{inst} \leq d_p \leq 0.5 r_{inst}.$$

Figure 9:
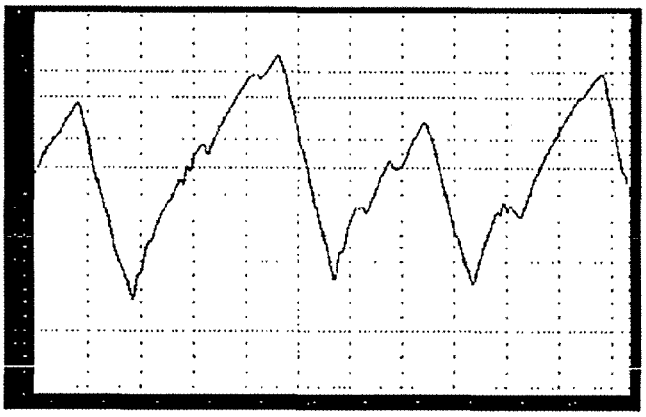
FIG. 9 is a record of the pressure fluctuations at the output of the bubble generator of FIG. 8.

Introduction of one or more pins 40 into exhaust diffuser 14 interferes with the orderly rotation of the liquid with dissolved bubbles at the generator's exit, creating intense vortexes, which generate oscillations having a given frequency and amplitude. Changing the diameter of the pin, the number of pins, the location at which they are installed, and the distance that they protrude into the exhaust diffuser of the generator changes the characteristics of the oscillations of the flow in the exhaust diffuser. FIG. 9 shows a plot of flow pulsations generated by the generator in an experimental study carried out with the following parameters: water flow rate $Q_w$=1.0 l/min, air flow rate $Q_a$=1.9×10$^{-3}$ l/min, bubble diameter in the range $d_b$=1.5 mm, and obtained frequency of oscillations 6.5 Hz.

The bubble generator of the invention is simply constructed, has no moving parts, allows creating liquid flow with dissolved air bubbles having a range of diameters at low energy consumption, and also can be adapted to create an unstable flow regime without complicating the design and the introduction of additional movable elements controlled by various types of actuators.

Although embodiments of the invention have been described by way of illustration, it will be understood that the invention may be carried out with many variations, modifications, and adaptations, without exceeding the scope of the claims.

The invention claimed is:

1. A bubble generator that has no moving parts and is configured to generate gas bubbles having a wide range of diameters in a liquid simply by changing the ratio of the flow rate of the gas to that of the liquid, the bubble chamber comprising:

a. a vortex chamber having a cylindrically shaped wall that defines a vortex chamber cavity;

b. openings in the cylindrically shaped wall through which the liquid is introduced tangentially into the vortex chamber cavity;

c. a cylindrical bushing with a blind gas channel that is coaxial with the vortex chamber; and d. orifices at the lower end of the gas channel in the bushing through which low-velocity gas jets are radially injected into the liquid flow near the center of the vortex chamber cavity.

2. The bubble generator of claim 1, comprising:

a. a body having a hollow side arm near its top through which liquid is introduced into the bubble chamber;

b. a cavity hollowed out of the interior of the upper part of the body into which the bushing and vortex chamber is inserted;

c. a cavity hollowed out of the interior of the lower part of the body, the cavity having the shape of an inverted cone that acts as an exhaust diffuser;

d. a space between the wall of the vortex chamber and the interior wall of the body, which is in fluid communication with the side arm and forms a liquid reservoir from which liquid flows tangentially through the openings in the vortex chamber wall into the vortex chamber cavity; and e. an opening at the bottom of the vortex chamber cavity that forms an outlet nozzle through which the two-phase medium leaves the vortex chamber and passes into the exhaust diffuser.

3. The bubble generator of claim 1, wherein there are n openings in the cylindrically shaped wall that are equally spaced around the circumference of the vortex chamber, wherein the n openings each have diameter $d_t$, length $L_t$, and their centers are offset from the center of the vortex chamber by distance R.

4. The bubble generator of claim 3, wherein the n openings are arranged in at least two layers separated by vertical distance L.

5. The bubble generator of claim 1, wherein the orifices at the bottom of the blind gas channel are equally spaced around the circumference of the bushing and have diameters $d_a$.

6. The bubble generator of claim 5, wherein the orifices are arranged in at least two layers that are separated by vertical distance L between centers and vertical distance Δ between the edges of orifices in two adjacent layers.

7. The bubble generator of claim 2, wherein the opening at the bottom of the vortex chamber cavity is comprised of a conical section having a cone angle α, which is coupled to the outlet nozzle having radius $r_n$ by means of a curved wall portion having radius of curvature r, and the outlet nozzle is connected to the exhaust diffuser by a tapered section of wall having maximum radius $r_d$.

8. The bubble generator of claim 7, wherein a is in the range 45 degrees to 120 degrees.

9. The bubble generator of claim 7, wherein the ratio $r:r_n$ is in the range 0.8-1.0.

10. The bubble generator of claim 2, wherein the ratio of the tangential flow velocity to the axial flow velocity of the two phase gas-liquid medium as it flows through the outlet nozzle of the vortex chamber is determined by a parameter $$A = \frac{R \cdot r_n}{n \cdot r_t^2}.$$

11. The bubble generator of claim 10, wherein the value of A is in the range of 4 to 6.

12. The bubble generator of claim 10, wherein the radius of the tip lateral surface the bushing at the location of the orifices is given by the equation:

$$r_b \geq r_n \cdot \sqrt{1-\varphi}$$

where:

$r_b$=the radius of the tip of the bushing;

$r_n$=the radius of the vortex chamber nozzle;

φ=a parameter, defined by the characteristic A of the vortex chamber, according to the following equation:

$$A = \frac{\sqrt{2}\,(1-\varphi)}{\varphi\sqrt{\varphi}}.$$

13. The bubble generator of claim 2, wherein when the ratio of the volume flow rate of water $Q_w$ to air $Q_{air}$ are in the range $22 \leq Q_w/Q_{air} \leq 28$ air bubbles with diameter 10-20 μm are obtained.

14. The bubble generator of claim 2, comprising at least one pin inserted into the exhaust diffuser to generate oscillations having a given frequency and amplitude in the two phase gas-liquid medium flowing out of the bubble chamber.

15. The bubble generator of claim 14, wherein the at least one pin protrudes into the exhaust diffuser a distance $0.3r_{inst} \leq L_p \leq 0.5r_{inst}$, where $r_{inst}$ is the radius of the cavity at the location of the at least one pin.

16. The bubble generator of claim 14, wherein the diameter $d_p$ of the at least one pin is related to the radius $r_{inst}$ by the equation $0.3r_{inst} \leq d_p \leq 0.5r_{inst}$.

* * * * *